United States Patent [19]

Suste

[11] 4,414,544

[45] Nov. 8, 1983

[54] CONSTANT DATA RATE BRIGHTNESS CONTROL FOR AN AC PLASMA PANEL

[75] Inventor: Joseph T. Suste, Orange, Calif.

[73] Assignee: Interstate Electronics Corp., Anaheim, Calif.

[21] Appl. No.: 273,095

[22] Filed: Jun. 12, 1981

[51] Int. Cl.[3] ..... G09G 3/28

[52] U.S. Cl. ..... 340/767; 340/793; 340/805

[58] Field of Search ..... 340/793, 805, 767, 766, 340/768, 791, 789; 315/169.1, 169.4

[56] References Cited

U.S. PATENT DOCUMENTS

| | | | |
|---|---|---|---|
| 4,002,828 | 1/1977 | Nolan | 340/793 |
| 4,006,298 | 2/1977 | Fowler et al. | 340/793 |
| 4,020,280 | 4/1977 | Kaneko et al. | 340/805 |
| 4,021,607 | 5/1977 | Amano | 340/805 |
| 4,067,047 | 1/1978 | Ryan | 340/793 |
| 4,183,062 | 1/1980 | Weisbrod | 340/805 |
| 4,193,095 | 3/1980 | Mizushima | 340/793 |
| 4,340,889 | 7/1982 | Knight et al. | 340/793 |
| 4,350,932 | 9/1982 | Coleman et al. | 340/768 |

*Primary Examiner*—Marshall M. Curtis

*Attorney, Agent, or Firm*—Knobbe, Martens, Olson & Bear

[57] ABSTRACT

A constant data rate brightness control for an AC plasma panel is disclosed in which a waveform ROM is used to store two groups of control signals. The first group performs sustain, write, erase, and bulk-erase functions in a normal manner emitting two pulses of light per cycle. The second group performs the same functions with emission of substantially no light. By mixing functions from the two groups and varying the ratio of the two groups, a broad range of variable brightness in the operation of the plasma panel is achieved.

18 Claims, 17 Drawing Figures

SINGLE BULK SUSTAINER IMPLEMENTATION

DUAL BULK SUSTAINER IMPLEMENTATION

| XS | XAP | OUTPUT |
|---|---|---|
| 0 | 0 | $V_{CC2}$ |
| 0 | 1 | 0 |
| 1 | 0 | $2V_{CC2}$ |
| 1 | 1 | $V_{CC2}$ |

Fig. 6

| YS | YAP | OUTPUT |
|---|---|---|
| 0 | 0 | NOT USED |
| 0 | 1 | 0 |
| 1 | 0 | 0 |
| 1 | 1 | $V_{CC2}$ |

Fig. 7A

| YS | YAP | OUTPUT |
|---|---|---|
| 0 | 0 | NOT USED |
| 0 | 1 | $V_{CC2}$ |
| 1 | 0 | $(V_{CC2})$ |
| 1 | 1 | $2V_{CC2}$ |

Fig. 7B

BRIGHTNESS CONTROL SUSTAIN FUNCTION

NORMAL SUSTAIN FUNCTION

BRIGHTNESS CONTROL WRITE FUNCTION

NORMAL WRITE FUNCTION

BRIGHTNESS CONTROL ERASE FUNCTION

NORMAL ERASE FUNCTION

BULK ERASE FUNCTION

| DATA INPUT 14 | NUMBER OF NORMAL MODE FUNCTIONS PER CYCLE | NUMBER OF BRIGHTNESS CONTROL MODE FUNCTIONS PER CYCLE | MAXIMUM COUNT | BRIGHTNESS OUTPUT AS A PERCENTAGE OF FULL BRIGHTNESS LEVEL |
|---|---|---|---|---|
| 000 | 1 | 7 | 7 | 12.5 % |
| 001 | 1 | 5 | 5 | 20 % |
| 010 | 1 | 3 | 3 | 25 % |
| 011 | 1 | 2 | 2 | 33 % |
| 100 | 1 | 1 | 1 | 50 % |
| 101 | 4 | 1 | 4 | 80 % |
| 110 | 7 | 1 | 7 | 88.5 % |
| 111 | ALL | NONE | COUNTER NOT USED | 100 % |

Fig. 16

CONSTANT DATA RATE BRIGHTNESS CONTROL FOR AN AC PLASMA PANEL

BACKGROUND OF THE INVENTION

AC plasma display panels are presently in commercial use as digitally addressable information display devices. The panel itself typically consists of two glass plates with a gas mixture sealed between them. A plurality of X-axis electrodes extend in a mutually parallel array on an interior substrate of one plate, and a plurality of Y-axis electrodes extend in a mutually parallel array on the interior of the other plate. The X-axis electrodes are at a ninety-degree angle to the Y-axis electrodes, thereby forming a plurality of intersections between the X-axis and Y-axis electrodes. A typical commercially available AC plasma panel has 512 X-axis electrodes and 512 Y-axis electrodes, yielding 262,144 intersections.

When a voltage between 180 and 200 volts is applied across an X-axis electrode and a Y-axis electrode, a discharge in the gas occurs at the cell formed by the electrodes, causing a pulse of light to be emitted at this point. Simultaneously, a charge is collected on the cell wall, which results in the cell being an "on" cell. Once such a discharge has been produced and the cell is turned "on", the collected wall charge acts to continue the discharging when a lesser AC sustain voltage is applied between the electrodes. In an "on" cell, the gas will discharge and the cell will emit a pulse of light at each transition of the applied AC sustain waveform. The sustain voltage, however, is insufficient to initiate a discharge at an X-Y intersection. This phenomenon is known as inherent memory, and was originally disclosed by Baker et al., U.S. Pat. No. 3,499,167, and by Bitzer et al., in U.S. Pat. No. 3,959,190. By precisely timing, shaping, and phasing multiple alternating voltage waveforms supplied to X and Y axes electrodes, the generation, sustaining and erasure of light emitting gas discharges at selected locations on the plasma display panel can be controlled.

An AC gas plasma display panel emits light at a sufficiently high intensity to be seen even in areas subject to sunlight. However, since for application of the panel in areas having a low level of ambient light the normal operation brightness of the display panel would be too brilliant, it is desirable to provide means for varying the brightness of the display.

Early attempts to lower the level of the intensity of light emitted from the display panel utilized smoked glass placed over the panel during operation in an area with a low ambient light level. Since plasma display panels may be used in areas subject to both normal sunlight and artificial illumination, this form of brightness control was found to be quite inconvenient, due to the wide variation in levels of illumination experienced.

Later attempts to make a variable intensity plasma-type display utilized several panels having a lower intensity than that of a typical plasma display panel, with the display panels stacked one on top of the other. Such devices require an optical alignment device, which usually is very cumbersome and not wholly effective, as well as being very expensive. This type of device is shown in United Kingdom Pat. No. 1,412,250 to Fujitsu Ltd. Another early type of brightness control used several cells in a plasma display panel as a single unit, selectively turning one through four of them on to vary the intensity of the brightness of the panel. Different applications using this approach are shown in U.S. Pat. No. 3,886,403 to Owaki et al., and U.S. Pat. No. 3,845,243 to Schmersal et al. The disadvantages of such an approach are two-fold: first, additional circuitry is required to selectively drive 25%, 50%, 75% or 100% of the cells in the panel, and this increases both the cost and the complexity of this type of device. The second, and more important, disadvantage of this approach is that the resolution capabilities of the panel are substantially diminished due to the fact that now only one-quarter of the number of picture elements formerly present are available.

The next approaches to variable brightness attempted to provide brightness control by varying parameters of the system. The first approach varied the waveform voltage or current applied to the plasma display panel. U.S. Pat. No. 3,654,388 to Slottow et al describes the use of a variable waveform voltage to control brightness, and U.S. Pat. No. 4,024,529 to Sakai discloses a variable current drive apparatus to vary brightness. The main disadvantage of these approaches is that their complexity makes them difficult to successfully implement on a commercial basis.

The next approach to varying system parameters is best shown in U.S. Pat. No. 3,906,209 to Kurahashi et al., in which the frequency of the sustain voltage is varied. When the frequency is lowered, the number of discharges will also be lowered, and the net amount of light apparent to the human eye is diminished. This approach, however, has a serious disadvantage in that the data rate of the system, in other words, the number of pictures that can be written and erased in a given period of time, is slowed to a point where data cannot be updated often enough to successfully implement a continuously operating system. Kurahashi recognized this, and decreased the sustain frequency of the system only between times when the panel was writing and erasing. However, this approach is unacceptable in a low light environment due to the fact that whenever a write or erase operation is undertaken, light generated will be at full intensity on the screen, possibly momentarily blinding operations of the system.

An offshoot of the frequency variation approach is shown in U.S. Pat. No. 4,149,111, to Coates, Jr. in which the system clock is interrupted in order to decrease the brightness of the display. Unfortunately, this approach completely disrupts the data rate of the system, and is not compatible with a constant data rate brightness control.

The most successful approach to brightness control in the past involved the simple concept of turning on and off elements of the display to control the net brightness of the display over a period of time. An early implementation of this type is disclosed in U.S. Pat. No. 3,570,156 to Easton, in which he writes and erases the display panel over and over. This, of course, presents the obvious disadvantage of not utilizing the inherent memory capabilities of the AC plasma display panel, and requires a large external hardware system. A later approach is shown in U.S. Pat. No. 3,863,023 to Schmersal et al., in which the cells desired to be brightest are turned on first, then the more dim cells are turned on, and finally the dimmest cells are turned on, and then the entire picture is erased simultaneously so that the cells desired to be brightest are turned on for the longest period of time. This, like the Easton device, does not have a true inherent memory display, and would require a large external hardware memory as well as extensive circuitry to control the duration and ordering of cell firings.

A more recent device using the pulse timing concept is disclosed in U.S. Pat. No. 4,006,208 to Fowler et al., in which pulses of different lengths are used in a binary coding scheme to vary the intensity of light emitted from the panel. This device requires extremely complex circuitry, and is not capable of having the display updated as rapidly as would be desired, due to the fact that the use or 64 time slots is required to produce one picture element on the panel.

SUMMARY OF THE INVENTION

The present invention solves the problems encountered in past devices through the use of a constant data rate feature in a brightness control system for an AC plasma panel. The constant data rate brightness control is easily inserted into the interface and control circuitry for an AC plasma panel with a minimum of changes to that circuit. The brightness control may be implemented in either a single sustainer type system or an older dual sustainer type system.

Four functions are used to control the operation of an AC plasma panel: the write function, the erase function, the sustain function, and the bulk-erase function. The write function causes a selected cell on the panel to change from the "off", or non-light emitting state, to the "on" or light emitting state. The sustain function maintains the state of all cells on the panel, i.e., causes "on" cells to remain on, and "off" cells to remain off. The sustain function also causes the "on" cells to emit light. The erase function causes a selected cell to be changed from the "on" state to the "off" state. The bulk-erase function causes all "on" cells in the panel simultaneously to be changed to the "off" state.

The control of brightness is accomplished by using two groups of the four above-mentioned control functions. The first group consists of normal sustain, write, erase, and bulk-erase functions; during operation of the panel using the normal functions, light is emitted from "on" cells in the panel at full intensity. The second group comprises a brightness control mode series of sustain, write, and erase functions. During operation of the panel using these brightness control functions, substantially no light is emitted from the "on" cells. The second group also includes a brightness control bulk-erase function which is identical to the normal bulk-erase function.

A broad range of variable brightness in the operation of the AC plasma panel is achieved by mixing the normal mode functions and the brightness control functions together to vary the intensity of light emitted from the panel. The system operates at a frequency of 50 KHz, so each one of the functions will have a time period of 20 microseconds. For example, to achieve half brightness, every other 20 microseconds the system would be operated in the brightness control mode. To achieve greater or lesser brightness, the ratio of normal mode functions to brightness control mode functions is varied.

Operation of the write, erase, sustain, and bulk-erase functions is generally controlled by four logic signals: the X-Sustain signal XS, the Y-Sustain signal YS, the X-Address Pulse XAP, and the Y-Address Pulse YAP. These signals, generally supplied by a waveform ROM (Read Only Memory), are digital pulse trains typically operating at a frequency of 50 KHz. The logic signals are supplied to the sustain and drive circuits, and cause the circuits to execute the four control functions on the panel. The X-Sustain signal and the Y-Sustain signal cause a sustain waveform to be supplied to every cell in the panel, and this sustain waveform causes all locations which have been written and not erased to be sustained; that is, to continue to use the inherent memory of the plasma panel. The X-Address Pulse and the Y-Address Pulse are used to cause write, erase, and bulk-erase operations to be performed, and cause write or erase waveforms to be directly only to specific locations on the panel where a write or erase function is being carried out. For bulk-erase, the entire panel is erased in one operation, so the bulk-erase waveform is sent to all locations on the panel. The routing of X-Address Pulses and Y-Address Pulses to desired areas on the plasma panel is carried out by addressing circuitry existing in the control circuitry and is well known in past devices.

The present invention utilizes a waveform Read Only Memory (ROM) integrated circuit chip to generate the four logic signal outputs which control which function is to be implemented. The waveform ROM is divided into eight separate address group locations. Address Groups 1 through 4 provide the normal mode bulk-erase, erase, write, and sustain functions, respectively. Address Groups 5 through 8 provide the brightness control mode bulk-erase, erase, write, and sustain functions, respectively. Each of these eight address groups provides a sequence for the four logic signals which are supplied by the waveform ROM. Operation of the ROM in any given address group will cause a specific sequence of the four logic signals to be outputted from the ROM. The waveform ROM is supplied with timing impulses from a system clock which causes the ROM to sequence through an address group in a time period of 20 microseconds. At the end of each 20 microsecond period, the system can switch from any one of the eight address groups to any other one of the address groups, or it can remain in the address group it is presently in. This feature represents substantial flexibility, since the system can be switched from one function to any other function at a frequency of 50 KHz.

The switching between these eight address groups in the waveform ROM is controlled by two inputs to the ROM, a brightness control input and a mode control input. The brightness control input selects whether the low order groups (Address Groups 1 through 4), which provide the normal mode functions, the high order groups (Address Groups 5 through 8), which provide the brightness control mode functions, will be implemented. The mode control input selects which of the four basic functions the waveform ROM will implement, that is, whether a bulk-erase function (Address Groups 1 or 5), an erase function (Address Groups 2 or 6), a write function (Address Groups 3 or 7), or a sustain function (Address Groups 4 or 8) will be implemented.

The brightness control input controls brightness of the plasma panel display by switching between the low order groups and the high order groups, thus interspersing normal mode waveforms with brightness control mode waveforms to vary the light intensity of the plasma panel. The brightness control input varies the ratio of the brightness control waveforms to normal waveforms, so that the brightness of the system can be controlled in discrete steps which will appear linear to the human eye.

A significant advantage of this system is its capability of continuously varying the brightness of a plasma panel display without slowing the rate at which data may be entered and displayed on the screen. This feature allows the display to be constantly updated even during the time the brightness control waveforms are being used to control brightness of the panel. Past systems were able to have only one of these two characteristics. Since the data rate of the system remains constant while the brightness of the panel is varied, the rate of data input can remain at the 50 KHz level typically used in plasma panel operations. This allows the brightness control to be installed in an existing system without extensive modifications of the interface circuitry of the existing system. It also provides the advantage of allowing the display to be updated much more rapidly than prior brightness control devices allowed. In addition the present invention has the advantage that any of the waveform ROM address groups can follow any of the other address groups, a feature not found in earlier systems. There are no sudden flashes on the plasma panel display, such as are found in some past systems. Since the inherent memory of the plasma panel is used to retain picture information while varying brightness, the necessity for a large external hardware memory is eliminated, thus reducing both circuit complexity and cost. Since no optical alignment devices are required, size, cost, and weight of the system are considerably reduced. In addition, the system is operational using only three power supply voltages, thus permitting further savings of size and cost over more elaborate power supplies required by past devices.

RELATED APPLICATIONS

This specification is one of a group of specifications on plasma display technology, all assigned to the present assignee, including: System For Driving AC Plasma Display Panel, Ser. No. 412,025, fled Aug. 27, 1982, which is a continuation of Ser. No. 166,579, Filed July 7, 1980 (now abandoned), by Joseph T. Suste; MOSFET Sustainer Circuit For An AC Plasma Display Panel, Ser. No. 258,757, Filed Apr. 29, 1981, by Larry F. Weber; Distributed Conditioning For An AC Plasma Panel, Ser. No. 273,093, Filed June 12, 1981 by Joseph T. Suste and Michael Marentic; Plasma Display Panel Drive Electronics Improvement, Ser. No. 272,885, Filed June 12, 1981, by Michael Marentic; Modular Waveform Generator For Plasma Display Panels, Ser. No. 273,092, Filed June 12, 1981 by Michael Marentic and Daniel Manseau; and Advanced Waveform Techniques For Plasma Display Panels, Ser. No. 273,094, Filed June 12, 1981, by Michael Marentic.

DESCRIPTION OF THE DRAWINGS

These and other advantages of the present invention are best understood through reference to the drawings, in which:

FIG. 6 shows the output to an X electrode being addressed, for a given X-Sustain XS and X-Address Pulse XAP input;

FIG. 7A shows the output, for a single sustainer implementation, of a Y electrode being addressed, for a given Y-Sustain YS and Y-Address Pulse YAP input;

FIG. 7B shows the output, for a dual sustainer implementation, of a Y electrode being addressed, for a given Y-Sustain YS and Y-Address Pulse YAP input;

FIG. 16 shows the various brightness levels used and the maximum count, the data input setting, and the number of functions used for each brightness level.

DESCRIPTION OF THE PREFERRED EMBODIMENT

Figure 1:
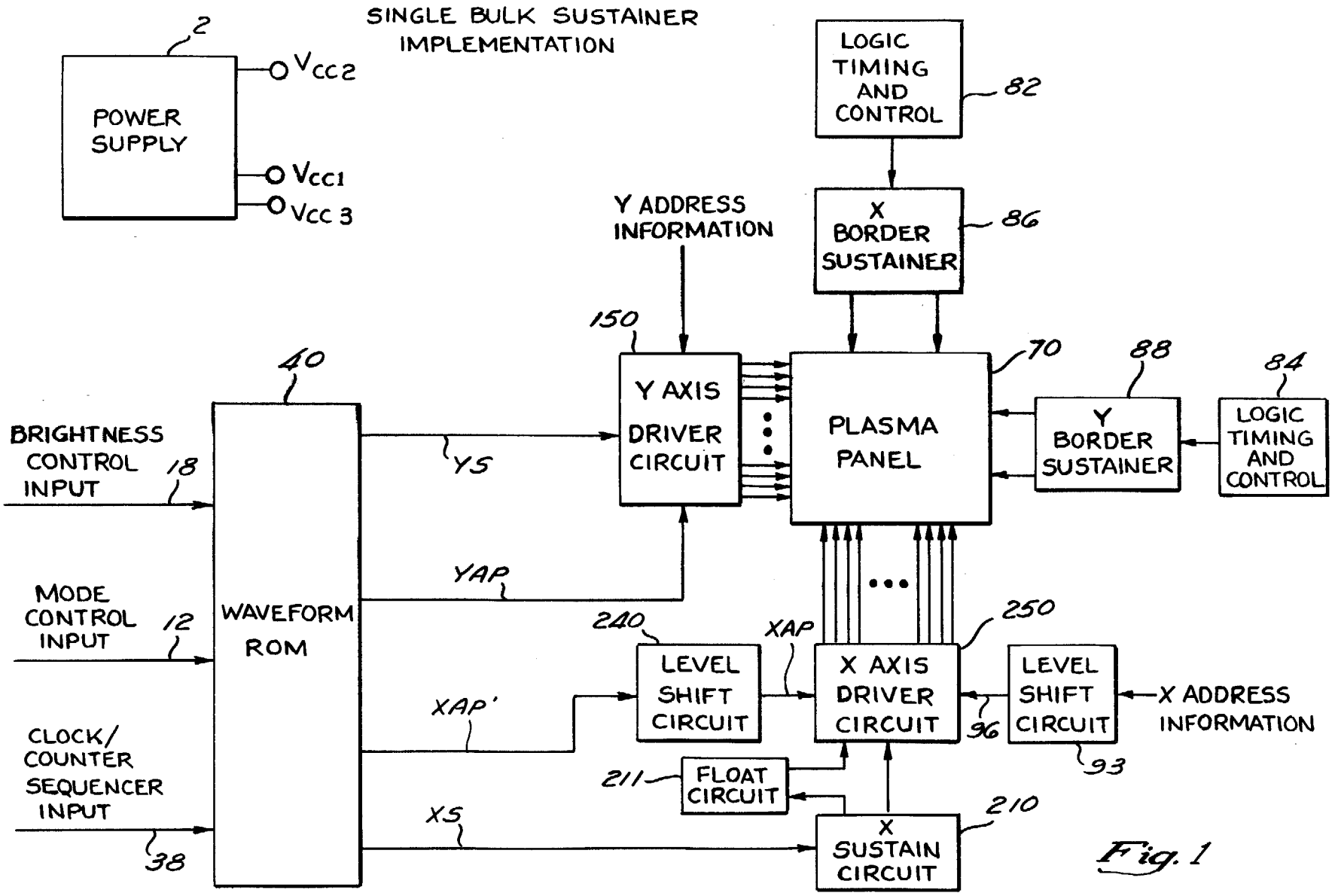
FIG. 1 is a block diagram of a single bulk sustainer implementation of the constant data rate brightness control.

FIG. 1 shows the present invention as implemented in a single bulk sustainer type system. A plasma panel 70 is typically a 512 by 512 AC gas plasma panel, and is available commercially. A power supply 2 supplies three levels of voltage: $V_{CC2}$, which is typically 90 to 100 volts: $V_{CC1}$, typically 12 volts for CMOS logic; and $V_{CC3}$, which is typically 5 volts for TTL logic.

The system is controlled by a waveform ROM (Read Only Memory) 40 which supplies four logic signals which cause the sustainer circuit 210, and the driver circuits 150 and 250, to control the operation of the plasma panel 70. Two of these logic signals are the X-Sustain signal XS, and the Y-Sustain signal YS, which are used to make the sustainer and driver circuits generate waveforms that cause locations on the panel which have been written and not erased to continue to emit light during normal operation of the panel. The other two logic signals supplied by the waveform ROM 40 are the X-Address Pulse XAP and the Y-Address Pulse YAP which are used to cause the sustainer and driver circuits to generate waveforms to perform the write and erase operations at selected locations on the panel. The bulk-erase operation to erase the entire panel is accessed by logic signals XS and YS.

In the normal mode of operation, there are four address groups containing logic signals to control the sustain, write, erase, and bulk-erase functions, each address group providing the necessary X-Sustain signal XS, Y-Sustain signal YS, X-Address Pulse XAP, and Y-Address Pulse YAP for the selected function. During the performance of these four functions, light will be emitted from the panel 70 at full intensity. Similarly, there are also provided four address groups for performing the four brightness control mode functions, each address group providing the necessary X-Sustain signal XS, Y-Sustain signal YS, X-Address Pulse XAP, and Y-Address Pulse YAP. During the operation of these four brightness control mode functions, substantially no light will be emitted from the plasma panel 70. These eight address groups of pulse trains are supplied from the waveform ROM 40.

With the exception of the bulk-erase logic signals, all of the normal mode logic signals are different from the brightness control mode logic signals. The bulk-erase logic signals are the same for both the normal mode and the brightness control mode, but they are loaded into two separate locations of the waveform ROM 40. In the waveform ROM 40, Address Groups 1 through 4 provide logic signals for generating the normal mode bulk-erase, erase, write, and sustain functions, respectively. Address Groups 5 through 8 provide logic signals for generating the brightness control mode bulk-erase, erase, write, and sustain functions, respectively.

Operation of the system in any address group will cause the four logic signals (the X-Sustain signal XS, the Y-Sustain signal YS, the X-Address Pulse XAP, and the Y-Address Pulse YAP) to be outputted from the ROM 40. These four logic signals are shown for the different functions in FIGS. 8 through 14. Operation of the system using these functions will produce outputs to the X-axis electrodes and Y-axis electrodes as shown by X-Driver and Y-Driver in FIGS. 8 through 14. The applied cell voltage X-Y waveform is the voltage seen at a selected cell, and is also shown in FIGS. 8 through 14, for different operations performed on the plasma panel 70. A cell not being addressed would see the applied cell voltage X-Y without the pulses caused by XAP and YAP.

FIGS. 8 through 14 thus show the seven different functions which are accessed by choosing one of the ROM address groups. The most important of the waveforms shown is the applied cell voltage X-Y. Whenever the applied cell voltage X-Y crosses AC zero, a pulse of light will be emitted from the panel at the selected cell if it is "on".

Figure 9:
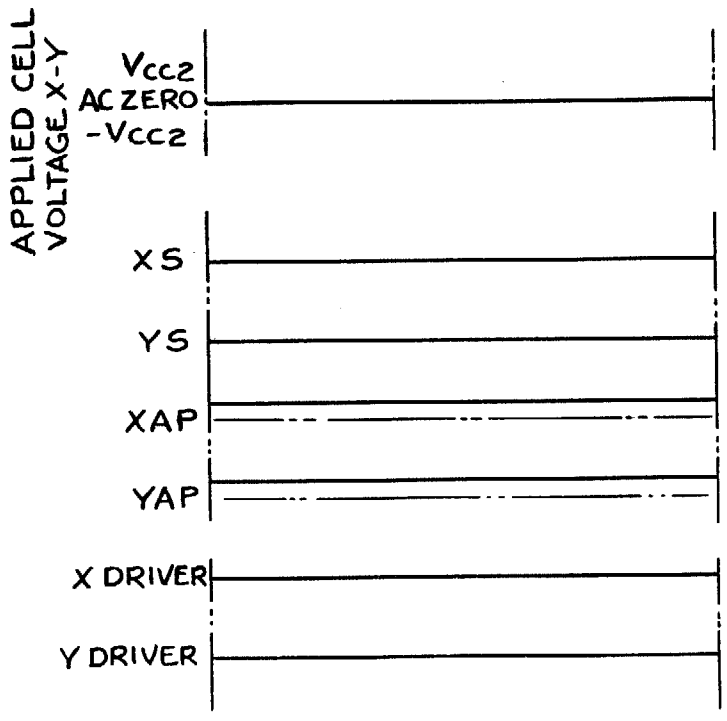
FIG. 9 shows the X and Y sustain and address pulses which are inputs to the sustainer and driver circuitry, the outputs of the driver circuitry, and the applied cell voltage X-Y for the brightness control sustain function.
Figure 8:
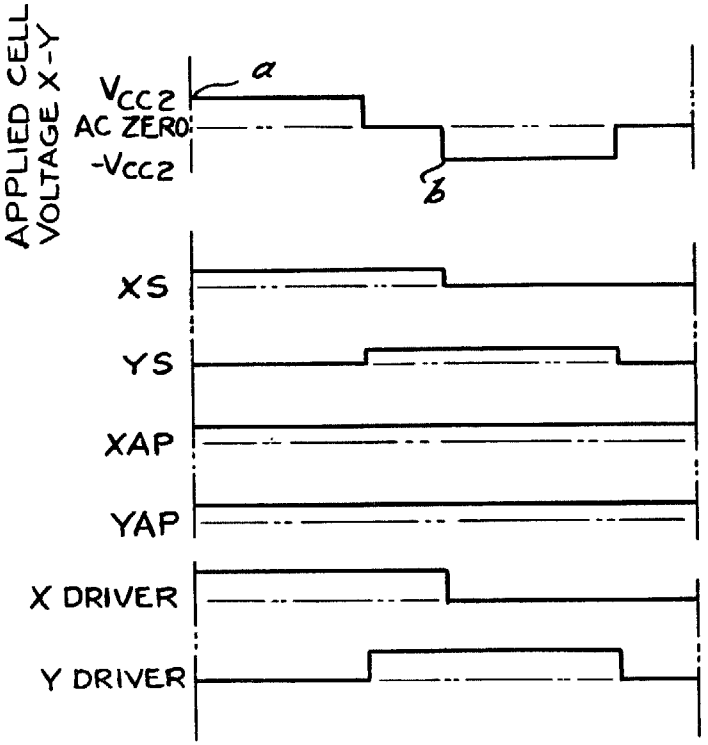
FIG. 8 shows the X and Y sustain and address pulses which are inputs to the sustainer and driver circuitry, the outputs of the driver circuitry, and the applied cell voltage X-Y for the normal sustain function.
Figure 11:
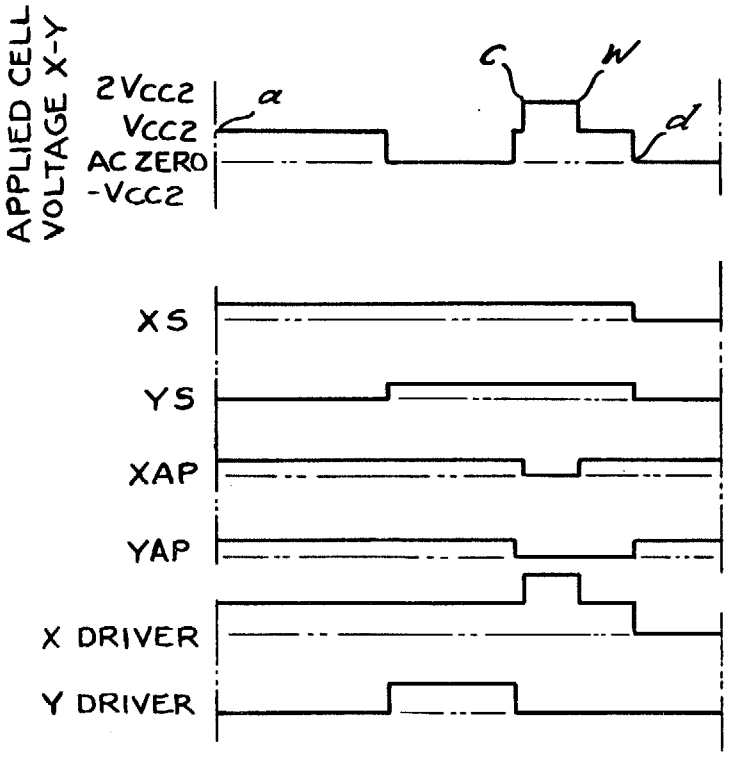
FIG. 11 shows the X and Y sustain and address pulses which are inputs to the sustainer and driver circuitry, the outputs of the driver circuitry, and the applied cell voltage X-Y for the brightness control write function.

Referring first to FIG. 8, the waveforms for the normal sustain function, the applied cell voltage X-Y crosses AC zero at two points, indicated by a and b. Therefore, in the normal sustain function, there will be two pulses of light emitted in the 20 microsecond period. In FIG. 9, the waveforms for the brightness control sustain function, the applied cell voltage X-Y, is at a permanent level of 0 volts. Since there are no crossings of AC zero during a brightness control sustain function, there will be no pulses of light emitted during the 20 microsecond period. It is important to note at this point that keeping the applied cell voltage X-Y at any constant voltage level would have the same effect; the level of 0 volts is chosen because it is desired to start and end each 20 microsecond period with the applied cell voltage X-Y at a level of 0 volts.

Figure 10:
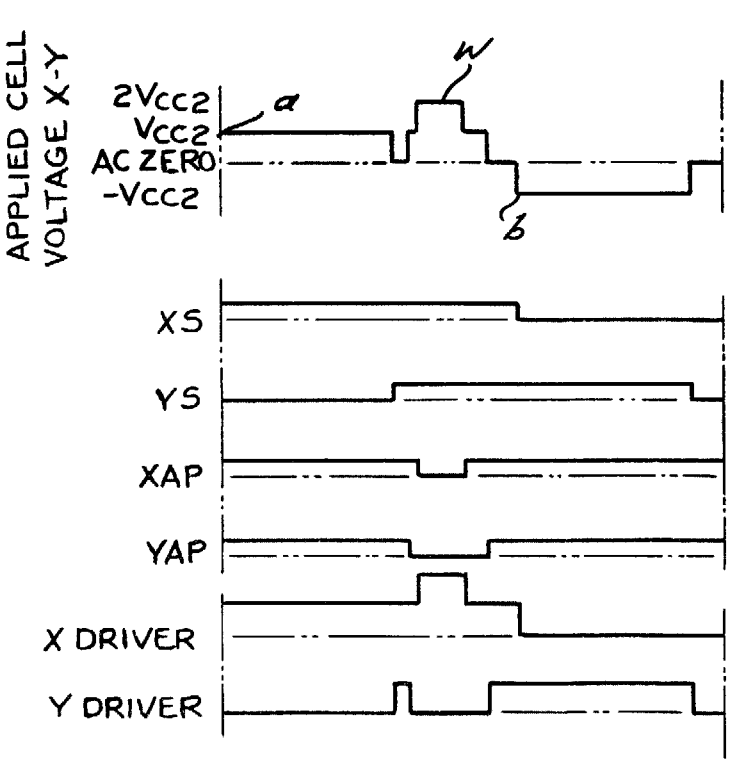
FIG. 10 shows the X and Y sustain and address pulses which are inputs to the sustainer and driver circuitry, the outputs of the driver circuitry, and the applied voltage X-Y for the normal write function.

In FIG. 10, the applied cell voltage X-Y is shown for the normal write function. A selected cell is turned on by placing a voltage of $2V_{CC2}$ across the cell as indicated at w on FIG. 10. There will be two pulses of light emitted by "on" cells at a and b. Contrast this with FIG. 11, the brightness control write function, where there are no crossings of the AC zero point. The write is still accomplished by using a $2V_{CC2}$ voltage level at w, but there is no pulse below the AC zero point. Because of this, the pulse at b in the normal write function is absent. If a group of write functions occur sequentially, the pulse at point a will also be absent. In the case of sequential write functions, for each write function after the first, there will be a shorter light pulse at point c, and a light pulse of about 1/10 intensity at point d. For whatever function follows the write sequence, there will be no pulse of light at a for that single function. While it is not possible in the write mode to completely eliminate the pulses of light from cells being addressed, it is possible to cut them approximately in half, and the light emitted is only emitted by the cell being turned on, not by the entire panel. The overall effect of the pulses at c and d is negligible.

Figure 13:
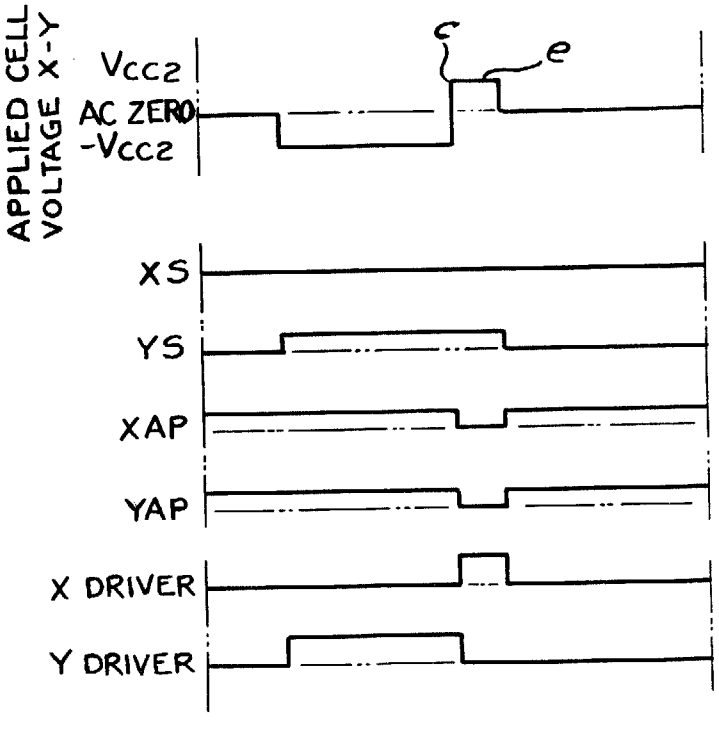
FIG. 13 shows the X and Y sustain and address pulses which are inputs to the sustainer and driver circuitry, the outputs of the driver circuitry, and the applied cell voltage X-Y for the brightness control erase function.
Figure 12:
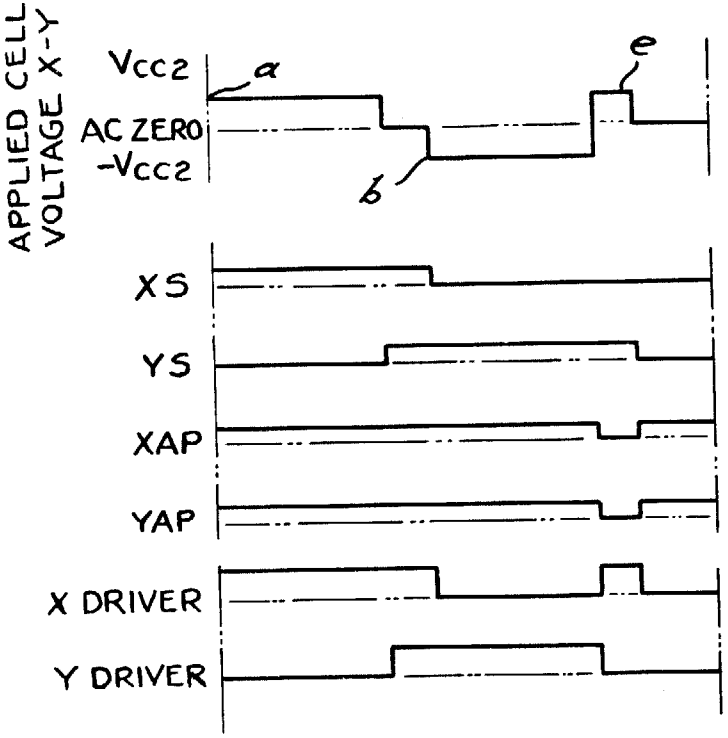
FIG. 12 shows the X and Y sustain and address pulses which are inputs to the sustainer and driver circuitry, the outputs of the driver circuitry, and the applied cell voltage X-Y for the normal erase function.

FIG. 12 shows the normal erase function, and FIG. 13 shows the brightness control erase function. Turning a cell "off" is accomplished by applying a short $V_{CC2}$ pulse to the cell immediately after a longer $V_{CC2}$ pulse was applied. FIG. 12 shows that there are two pulses of light caused by AC zero crossings at a and b, and FIG. 13 shows that there will be only one very short pulse of light at point c, and that pulse of light is from the cell being turned off. The rest of the panel will not emit light. Again, in the brightness control erase function, it is not possible to completely eliminate the emission of light from the cells being addressed, light has been diminished by about 75% since the pulse of light at point c is a short pulse. The overall effect of the pulse at c is negligible.

Figure 14:
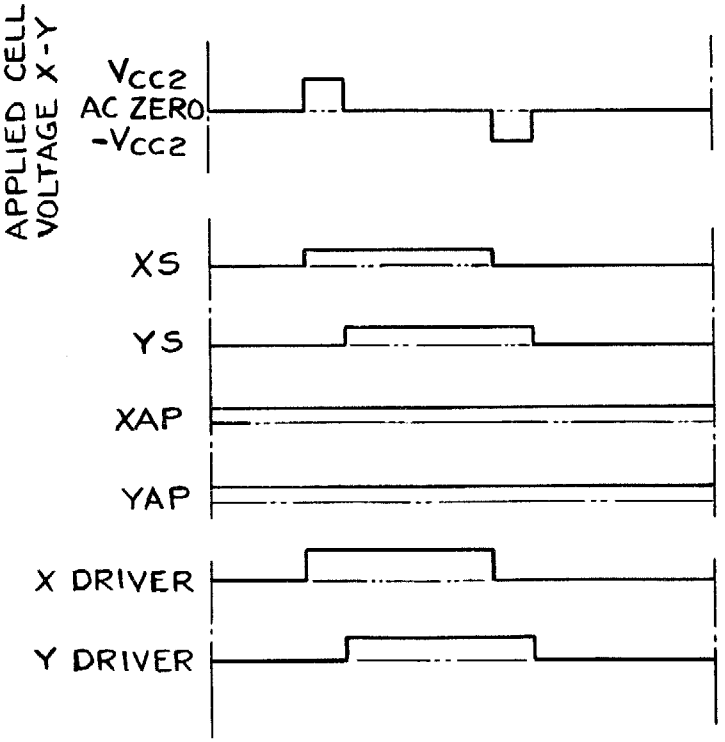
FIG. 14 shows the X and Y sustain and address pulses which are inputs to the sustainer and driver circuitry, the outputs of the driver circuitry, and the applied cell voltage X-Y for the bulk-erase function.

FIG. 14 shows the bulk-erase function, which is used in both the normal and brightness control modes. All cells on the panel are erased by the short $V_{CC2}$ and $-V_{CC2}$ pulses, which are applied to the entire panel since they are caused by sustain signals and not by the address pulses.

The present invention achieves a wide range in variation of brightness intensity by mixing normal mode functions with brightness control functions to obtain the level of brightness desired. For example, by making every other function a brightness control function, the level of brightness can be set at a level of 50% of normal brightness By varying the ratio of normal and brightness control mode functions, brightness can be varied from full intensity down to a low level of intensity in increments small enough so that, to the human eye, the rate of diminution of brightness appears to be approximately linear.

Figures 3, 3A:
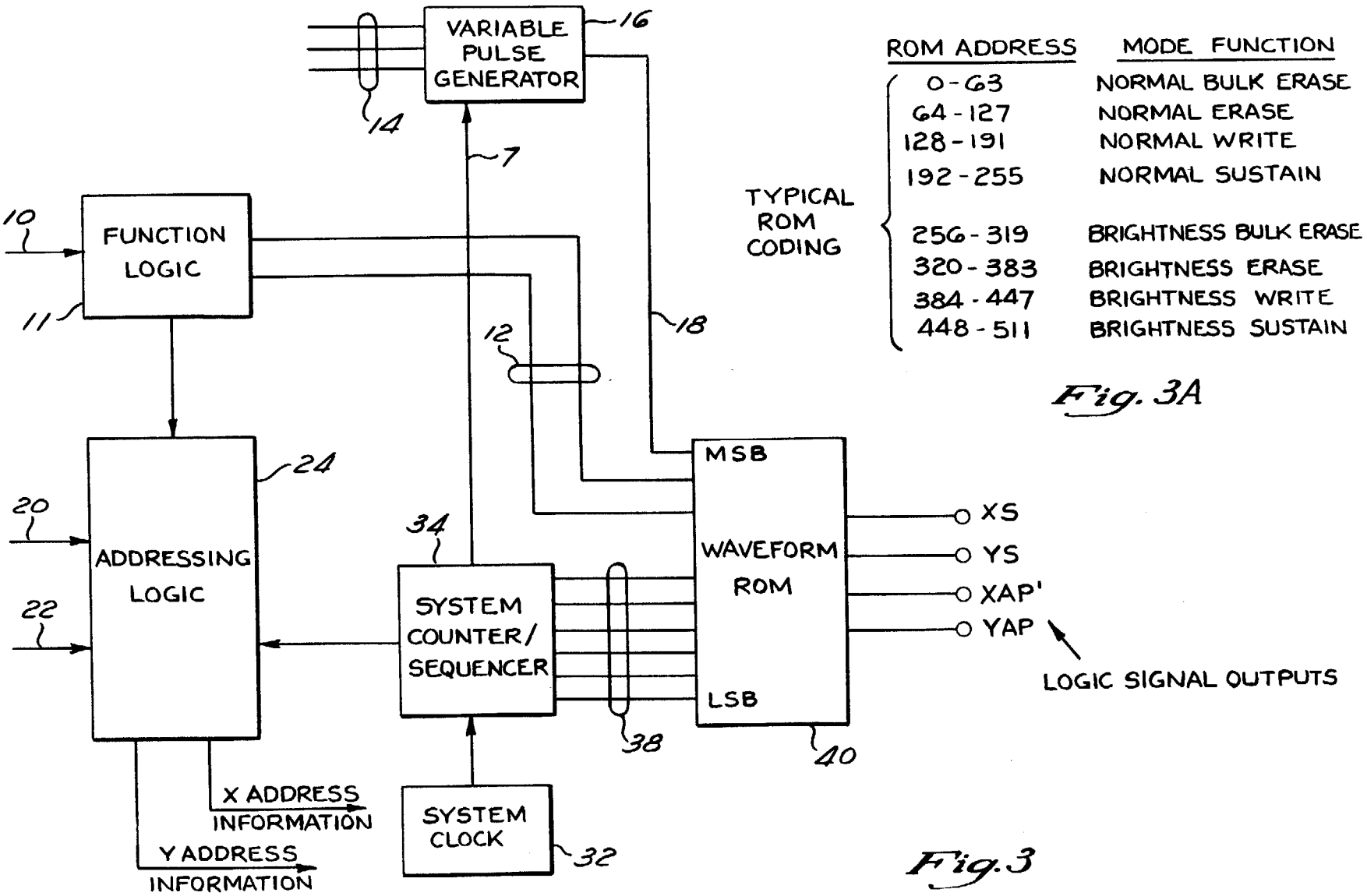
FIG. 3 is a block diagram of the interface and control circuitry, including the waveform ROM and its logic signal outputs.

Referring once again to FIG. 1, a brightness control input 18 and a mode control input 12 determine which of the address groups in the waveform ROM 40 will be accessed. The brightness control input 18 determines whether the address group to be accessed is in the low order groups (1 through 4) which contain the normal mode functions, or the high order groups (5 through 8) which contain the brightness control mode functions. A logic level of 0 will cause the low order groups to be accessed, and a logic level of 1 will result in the high order groups being accessed. The mode control input has two digital lines which will select which of the four basic functions the waveform ROM 40 will implement: a bulk-erase function (Address Groups 1 or 5), an erase function (Address Groups 2 or 6), a write function (Address Groups 3 or 7), or a sustain function (Address Groups 4 or 8). The chart in FIG. 3A shows that ROM addresses 0 through 255 are used for the first four address groups, and addresses 256 through 511 are used for the second four address groups.

The waveform ROM 40 will sequence through each of these address groups in a period of 20 microseconds, for a system operational frequency of 50 KHz. The entire system is controlled by a clock/counter/-sequencer input 38, which provides six lines of digital timing information for the waveform ROM 40. By utilizing the output of the brightness control 18 as the most significant address bit, the outputs of the mode control 12 as the two next most significant bits, and the clock 38 as the six least significant address bits, a complete, composite address is provided for the ROM 40.

Figure 15:
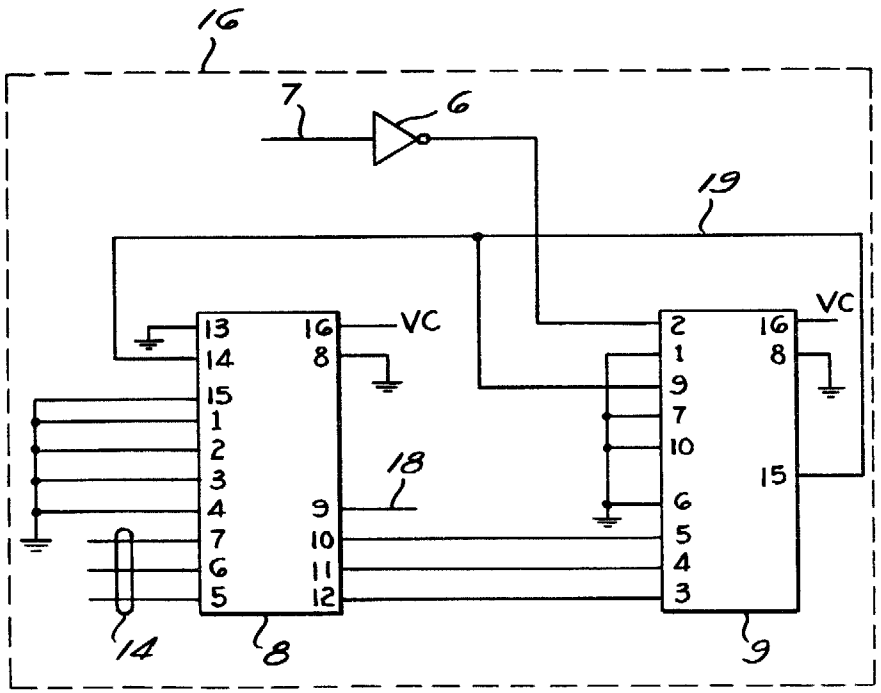
FIG. 15 is a schematic diagram of the brightness control input circuitry.

The brightness control input 18 is supplied by a variable pulse generator 16, as shown in FIG. 15. The components of the circuit include a ROM chip 8, typically a Fairchild 93446, and a counter chip 9, typically a Texas Instruments 54LS169, which is set to count down. Timing information is supplied through an inverter 6 at line 7. The data inputs 14 may be set manually by switches, or automatically by a computer.

The data inputs 14 have three functions. First, if all the data inputs 14 are ones, the counter chip 9 will not be used, since the 111 input indicates a full brightness instruction. The output of the ROM chip 8 on line 18, in this case, will be zero, causing the first four address groups in FIG. 3A to be used exclusively.

The second function of the data inputs 14 is to access data from the ROM chip 8 to indicate to the counter chip 9 from what number it is to count down before resetting (maximum count). The maximum count of the chip 9 is predetermined and is based on the ratio of normal mode functions and brightness control functions in a cycle. The maximum count number for the various ratios used is given in the chart in FIG. 16, and is the sum of normal mode functions and brightness control mode functions in a cycle minus one.

While the counter chip 9 is counting, it outputs a logical one on line 19. When the counter chip 9 countdown reaches zero, it will output a logical zero on line 19 and reset, to begin counting again. The output of the counter chip 9 is supplied to the ROM chip 8 on line 19.

The ROM chip 8 will output a signal which is the brightness control input 18. This signal is directly based on the output of the counter chip 9, and its generation is the third function controlled by the data inputs 14. If the data inputs 14 are 000, 001, 010, 011, or 100, the signal output of the ROM chip on line 18 will be identical to the output of the counter chip 9 on line 19. This method of operation provides brightness less than or equal to 50% of full brightness. If the data inputs 14 are 101 or 110, the output of the counter chip 9 on line 19 will be inverted to obtain the signal output of the ROM chip 8 on line 18. This method of operation provides brightness greater than 50% of full brightness. For the 111 data input, the counter is not used.

In the preferred embodiment, the levels of brightness used are shown in FIG. 16 as "brightness output as a percentage of full brightness level".

These particular levels are chosen because they provide what appears to the human eye to be relatively linear diminution of brightness. The 12.5% intensity is the lowest level used because it is sufficiently dim in a low ambient light environment to avoid annoying strain on the eyes.

Referring again to FIG. 1, the waveform ROM 40 outputs an inverse X-Address Pulse XAP' instead of an X-Address Pulse XAP. The reason for this is that the X-axis driver circuit 250 operates utilizing a floating ground, so a level shift circuit 240 must be used. The level shift circuit commonly inverts the signal supplied to it, so therefore an inverse X-Address Pulse XAP' is needed. The X-Sustain XS waveform is supplied to the X-Sustain circuit 210, which is preferably the MOSFET sustainer circuit for an AC plasma display panel disclosed in a copending application Ser. No. 258,757, Filed Apr. 29, 1981, by Larry F. Weber, assigned to the assignee of the present invention, and that specification is hereby incorporated herein by reference. The Y-Sustain YS and Y-Address Pulse YAP are connected to a Y-axis driver circuit 150. A float circuit 211 is used to supply the X-axis driver circuit 150 with power.

A computer is used to supply the interface circuitry in FIG. 3 with information describing the operations to be performed (sustain, write, erase, and bulk-erase functions), and the locations to be addressed. The computer is standard in the art. It sends information describing which locations are to be addressed on lines 20 and 22 to the interface and control circuit depicted as addressing logic 24. The addressing logic 24 outputs X-address input information and Y-address information in a format usable by the driver circuits 150 and 250 in FIG. 1. Since the use of a level shift circuit 93 is required, the information from the addressing logic 24 will be inverted as necessary to reach the driver circuits 150 and 250 in the proper form.

Information describing which locations on the plasma panel are to be addressed is input to the driver circuits 150 and 250. Here again, since the X-axis driver circuit 250 has a floating ground, X-address information is supplied through the level shift circuit 93. The method of supplying the X-address information and Y-address information is the same as used in other devices in the past, which is an important advantage since the circuitry used to supply the addressing information does not have to be changed in order to implement the present brightness control system. The level shift circuits 93 and 240 are also of the type commonly used in past circuit designs of this type. For example, a transformer-buffer combination or an optical isolation device may be used.

Also shown in FIG. 1 are logic timing and control inputs 82 and 84, which control an X-border sustainer 86 and a Y-border sustainer 88, respectively. The function of the X-border sustainer 86 and the Y-border sustainer 88 is to generate ions in the plasma panel 70 so that the write function can be accomplished with complete accuracy, and they are as commonly used in the prior art.

Figure 2:
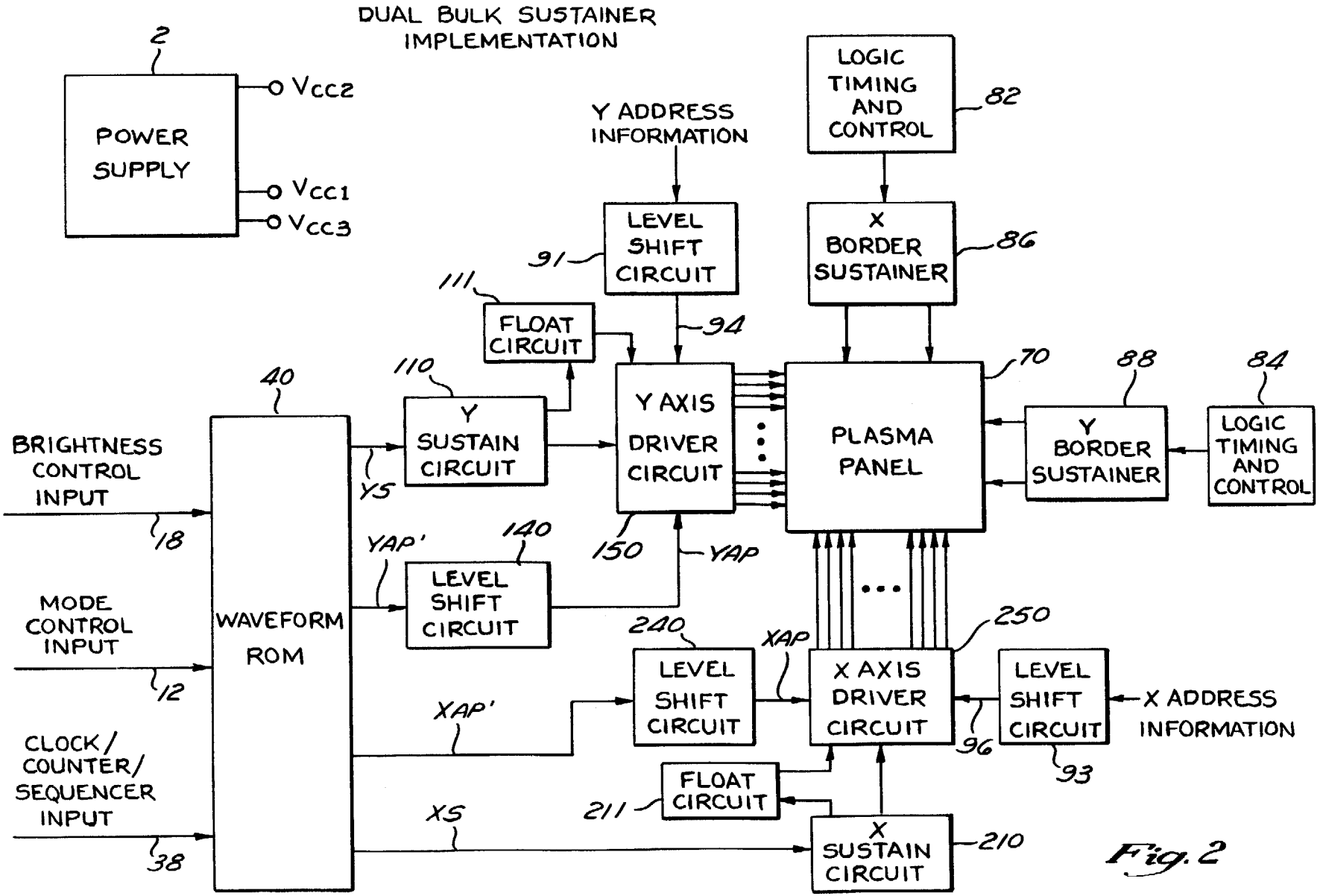
FIG. 2 is a block diagram of a dual bulk sustainer implementation of the constant data rate brightness control.

The single bulk sustainer implementation shown in FIG. 1 is preferable over the dual bulk sustainer implementation shown in FIG. 2 since the circuitry needed is less complex. In a single bulk sustainer implementation, the Y-axis driver circuit 150 operates to provide both driver and sustainer functions to the Y-axis electrodes. In the past, it has been found that currently available Y-axis driver chips such as the SN75501 are not capable of handling both driver and sustain functions over a period of time, and are subject to a higher than desired rate of failure. It is possible that in the future, this problem will be eliminated, and the dual bulk sustainer implementation will become less preferable. However, since the dual bulk sustainer is the better current implementation, it, as well as the single bulk sustainer implementation, will be described in the specification.

FIG. 2 shows such a dual bulk sustainer implementation in block diagram form. The additional circuitry is a Y-sustainer circuit 110, a float circuit 111, and level shift circuits 91 and 140. The level shift circuits 91 and 140 function like level shift circuits 93 and 240 to convert the ground-based input to a floating ground-based output. In addition, the waveform ROM 40 is programmed to output an inverse Y-Address Pulse YAP', since the level shift circuit 140 will invert the inverse Y-Address Pulse YAP' to a Y-Address Pulse YAP, which is then supplied to Y-axis Referring now to FIG. 3, the interface circuitry between the computer and the plasma panel 70, and the driver and sustainer circuitry is shown in block diagram form. The entire system is driven by a system clock 32, the output of which is supplied to a system counter/-sequencer 34. The system counter/sequencer 34 supplies six lines of timing signals 38 to the waveform ROM 40. These timing signals 38 cause the ROM 40 to sequentially operate through the 64 addresses in each of the eight ROM address groups.

The variable pulse generator 16 described above supplies the brightness control input 18 to the waveform ROM 40. The brightness control input 18 from the variable pulse generator 16 controls whether the first four ROM address groups or the second four ROM address groups will be accessed. The computer also sends a signal 10 to the function logic 11 which determines which of the four functions is to be implemented. Depending on which function is to be implemented, the appropriate output will be generated as the mode control input 12 to the waveform ROM 40. For example, when the mode control input 12 is 00, the bulk-erase function will be implemented. Likewise, when the mode control input 12 is 01, 10, or 11, the erase, write, or sustain functions, respectively, will be accessed. Therefore, when the brightness control input 18 and the mode control input 12 supply the signal 101, the system will operate in the brightness control mode, as determined by the first bit, and will perform the erase function as determined by the second and third bits, corresponding to ROM address 320–383.

Since the system operates at a frequency of 50 KHz, one cycle will take 20 microseconds to complete. Therefore, in 20 microseconds, the waveform ROM 40 will sequence through addresses 320 to 383 (FIG. 3A), when the brightness control input 18 and the mode control input 12 supply the 101 input signal. Since each group of 64 ROM address slots is sequenced in 20 microseconds, this system has the advantage of being able to go from any one of the eight ROM address groups to any other one of the eight ROM address groups, or repeat the ROM address group just completed, at the end of each cycle. This is a highly desirable feature, and allows considerable flexibility in operation of the plasma panel system. Each ROM address group causes the four logic signal outputs described above and shown in FIGS. 8 through 14 to be accessed.

The computer determines which locations on the plasma panel 70 will be accessed in a given time period by use of the X-input 20 and the Y-input 22, both of which are connected to addressing logic 24. The addressing logic 24 is commonly known in the art, and is not changed by the addition of the present invention. This, of course, is a significant advantage, since the addition of the constant data rate brightness control does not necessitate the changing of any of the addressing logic circuitry. The addressing logic 24 has two outputs, which become inputs to the X-axis driver circuit 250 and the Y-axis driver circuit 150; these inputs to the drivers provide the X-address information and the Y-address information, both of which are shown to be connected to the circuits in FIGS. 1 and 2.

Figure 4:
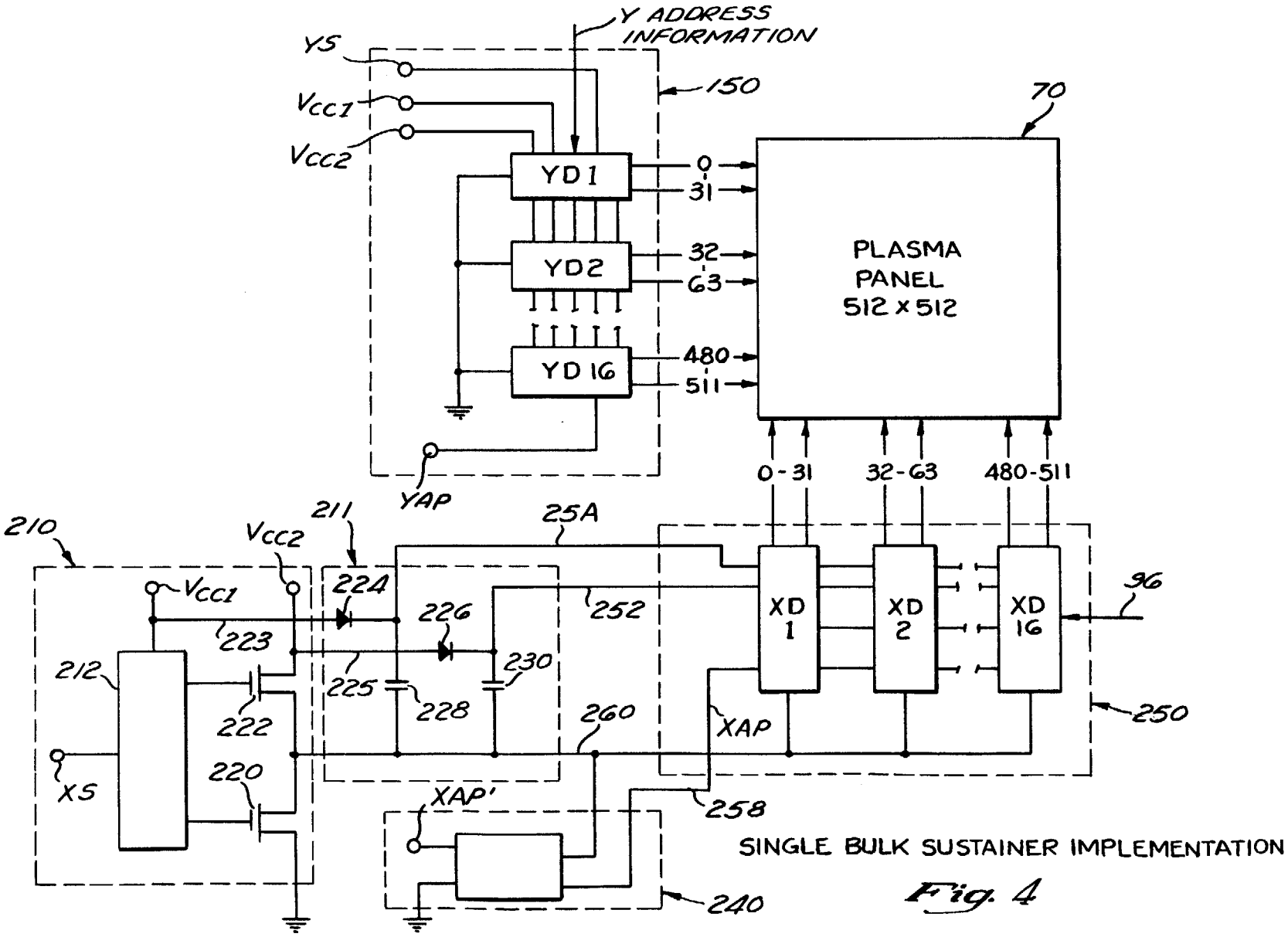
FIG. 4 is a schematic diagram of the sustainer and driver circuitry for a single bulk sustainer implementation.

FIG. 4 shows the sustainer and driver circuitry for a single bulk sustainer implementation. Components of this diagram shown in dotted lines correspond to blocks shown in FIG. 1. FIG. 4 thus contains the Y-axis driver circuit 150, the float circuit 211, the X-axis driver circuit 250, the X-sustainer circuit 210, and the level shift circuit 240.

In the Y-axis driver circuit 150, YD1 through YD16 are Y-axis driver chips SN75501. These chips are supplied with $V_{CC1}$ and $V_{CC2}$ at the points indicated, and are grounded. The Y-address information is supplied as shown. The Y-Sustain YS from the waveform ROM 40 is supplied to the Y-axis driver chips on the sustain pin, and the Y-Address Pulse YAP, also from the waveform ROM 40, is supplied to the strobe pin of the chips.

The X-sustain circuit 210 has as its sustainer control circuitry 212 the MOSFET sustainer circuit identified above. When the X-Sustain signal XS is at a logic level of 1, a transistor 222 will be turned on, and when the X-Sustain signal XS is at a logic level 0, a transistor 220 will be turned on. The transistors 220 and 222 are never both on at the same time. $V_{CC1}$ and $V_{CC2}$ are supplied as indicated. The transistors 220 and 222 have a common connection at line 260 which is the floating ground. Therefore, it can be seen that when the X-Sustain signal XS is at a logic level of 1, the transistor 222 will be turned on, will conduct between its drain and source, and will raise the sustainer output 260 to a level of $V_{CC2}$. When the X-Sustain signal XS is at a logic level of 0, the transistor 220 will turn on, connecting its drain and source to reduce the level of the floating ground 260 to ground potential, since the transistor 220 is connected to ground.

Capacitors 228 and 230 are connected to the floating ground 260. The other side of the capacitor 228 is connected through diode 224 to $V_{CC1}$ by line 223. Thus, it can be seen that the capacitor 228 will act as a floating power supply with a level of $V_{CC1}$ at line 254 with respect to the floating ground 260. In the same way, the capacitor 230 is connected through the diode 226 to the $V_{CC2}$ input by line 225; thus, the capacitor 230 will act as a floating $V_{CC2}$ at line 252 with respect to the floating ground 260.

The X-axis driver circuit 250 has 16 X-driver chips, which are commonly SN75500 chips. The ground pin of these chips at point 260 is connected to the floating ground 260. The X-axis driver chips XD1 through XD16 are supplied with logic level power on line 254, which is connected to the floating $V_{CC1}$ power supply of the capacitor 228. The $V_{CC2}$ input for the X-driver chips is on line 252, and it is connected to the floating $V_{CC2}$ of the capacitor 230.

The X-Address input to the X-driver chips is input at location 96, and is output from the level shift circuitry 93 (FIG. 1). The inverse X-Address Pulse XAP' is supplied to the level shift circuit 240, and is ground based. The output of the X level shifter 240 is supplied to the floating ground 260 and the X-axis drivers XD1 through XD16. The signal entering on line 258 is the X-Address Pulse XAP, which is floating with respect to the same floating ground as the X-driver chips.

Figure 5:
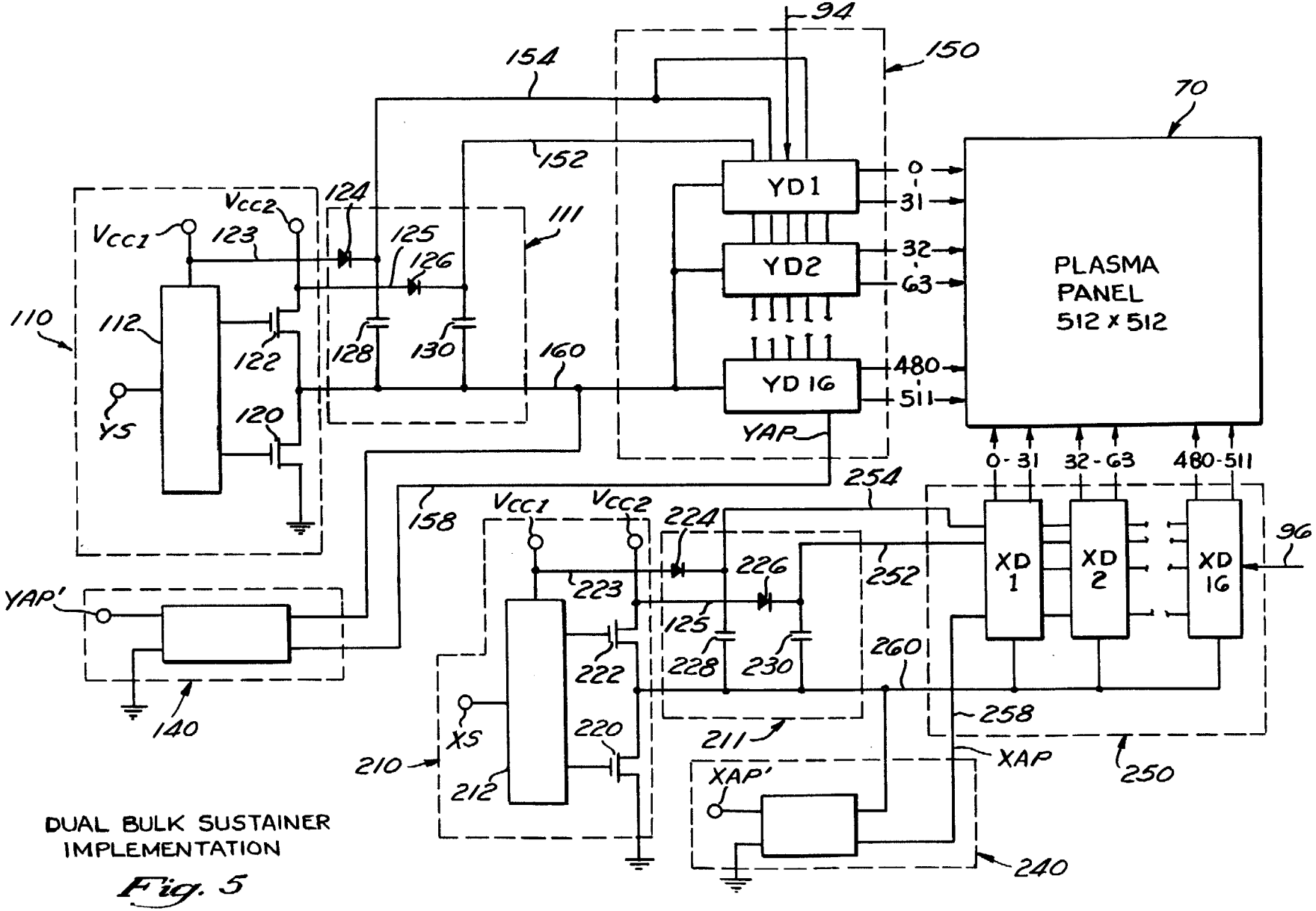
FIG. 5 is a schematic diagram of the sustainer and driver circuitry for a dual bulk sustainer implementation.

FIG. 5 contains a circuit diagram of the dual bulk sustainer implementation shown in block form in FIG. 2. The X-sustain circuit 210, the X-axis driver circuit 250, and the X-level shift 240 are the same as in the single bulk sustainer implementation of FIG. 4, and operate in the same fashion. FIG. 5 additionally shows a Y-sustain circuit 110, a Y-level shifter 140, a float circuit 111, and a Y-axis driver circuit 150 which is slightly different from that of FIG. 4.

The Y-axis circuitry operates in the same way as the X-axis circuitry, with one exception. The sustain pin of the Y-axis driver chips, which was connected to the Y-Sustain YS waveform in the single sustainer implementation, is connected to line 154, which is the floating $V_{CC1}$, so the input to the Y-driver chips YD1 through YD16 on the sustain pin will always be high. Except for this difference, the Y-axis circuitry operates the same as the X-axis circuitry, and components of the Y-axis circuitry are denoted by numbers which are 100 less than the numbers of the corresponding X-axis component.

The sustainer and driver circuitry uses the X-Sustain signal XS, the Y-Sustain signal YS, the X-Address Pulse XAP, and the Y-Address Pulse YAP to determine the voltage levels applied to the panel 70. The sustainer and driver circuitry produces the waveforms described above and shown in FIGS. 8 through 14, which perform the desired functions on the plasma panel.

The function of a driver chip for a plasma panel is two-fold: first, it must supply all the electrodes with a sustain signal at all times. Secondly, it must supply selected electrodes with an addressing pulse. When the X-driver 250 and the Y-driver 150 both supply an addressing pulse to the same cell, that cell will be completely addressed, causing a write or erase function to be performed.

The driver chip is a switching device. It will at all times supply the electrodes with a sustain voltage. It will provide selected electrodes with additional voltage levels necessary to perform a write or erase function. The operation of the sustainer and driver circuitry, which is entirely standard in the art, may be summarized by use of the charts in FIGS. 6, 7A, and 7B.

The chart in FIG. 6 shows the output to an X electrode being addressed for the various X-Sustain signal XS and X-Address Pulse XAP combinations, for a single bulk sustainer implementation. The output in FIG. 7A for inputs YS and YAP both at zero is not used because of a logic flow inherent in the SN75501 driver chip. The chart in 7B shows the output to an addressed Y electrode for a dual bulk sustainer system. The output shown in parenthesis in FIG. 7B are not used in order to minimize power dissipation in the Y-driver chips. The output in FIG. 7B for YS and YAP inputs both at zero is not used, since it would yield an output to the Y-electrodes not allowable for operation of the system as disclosed.

By varying the output to a Y-electrode between $V_{CC2}$ and 2 $V_{CC2}$, the effect is to place a DC offset equivalent to the magnitude $V_{CC2}$. Since the DC offset is continuously applied, the system operates identically whether the output to the Y-electrodes varies from Ø to $V_{CC2}$, or from $V_{CC2}$ to 2 $V_{CC2}$.

It can be seen that the present invention provides a means of brightness control without lowering the rate of data to be displayed on the plasma display panel. By this use of a waveform ROM containing eight address groups, it is quite simple to move from any one of the eight functions to any other one of the eight functions at a rate of 50 KHz. Therefore, a constant data rate brightness control enables the plasma panel to be operated at full speed over a wide range of brightness levels. There are no sudden flashes caused by a rapid change in intensity due to write or erase functions, as was present in some prior devices. The present invention allows the use of the panel in a wide range of ambient light conditions, with no problems in reading the plasma display because the display is either too bright or too faint. Large external memory capability is not necessary, since the inherent memory of the plasma panel is used to full advantage, therefore reducing both circuit complexity and cost. No optical alignment devices are required. Finally, the system is operational using only three power supply voltages, presenting further savings in size and cost over past devices and requiring less cooling capability than past devices.

What is claimed is:

1. A brightness control for an AC plasma panel having an inherent memory and having sustainer and driver circuitry, comprising:

means for generating:

(a) a first group of pulse trains controlling said sustainer and driver circuitry, said pulse trains executing sustain, write, and erase functions on said plasma panel with the emission of a first light level from said panel; and (b) a second group of pulse trains controlling said sustainer and driver circuitry, said pulse trains executing sustain, write, and erase functions on said plasma panel with the emission of a second light level from said panel;

(c) wherein both said write functions set said inherent memory and both said erase functions unset said inherent memory; and brightness selection means connected to said generating means and producing a signal which causes said generating means to selectively, alternatively output said first and second groups of pulse trains.

2. A brightness control for an AC plasma panel, as defined in claim 1, wherein said first group of pulse trains and said second group of pulse trains are of equal duration to permit said brightness control to operate at a constant data rate.

3. A brightness control for an AC plasma panel, as defined in claim 1, wherein said generating means comprises a digital data memory.

4. A brightness control for an AC plasma panel, as defined in claim 3, wherein said digital data memory comprises two addressable data groups:

a first addressable data group defining said first group of pulse trains; and a second addressable data group defining said second group of pulse trains.

5. A brightness control for an AC plasma panel, as defined in claim 4, wherein said first and second addressable data groups each comprise four separate addressable blocks of data, each addressable block defining four pulse trains.

6. A brightness control for an AC plasma panel, as defined in claim 4, wherein:

said first addressable data group comprises addressable blocks of data for defining sustain, write, erase, and bulk-erase functions for execution on said plasma panel with the emission of light; and said second addressable data group comprises addressable blocks of data for defining sustain, write, and erase functions for execution on said plasma panel with the emission of substantially no light, and an addressable block of data for defining a bulk-erase function for execution on said plasma panel.

7. A brightness control for a plasma panel, as defined in claim 1, wherein said first group of pulse trains executes said sustain and write functions at substantially equal intensity.

8. A brightness control for a plasma panel, as defined in claim 1, wherein said second group of pulse trains executes said sustain and write functions at substantially equal intensity.

9. A brightness control for an AC plasma panel, as defined in claim 1, wherein said plasma panel exhibits inherent memory actuated by said pulse trains executing said sustain function.

10. A brightness control for an AC plasma panel, as defined in claim 1, additionally comprising:

means for controlling said brightness selection means to vary the ratio of said second group of pulse trains to said first group of pulse trains to vary the intensity of light emitted from said plasma panel.

11. A brightness control for an AC plasma panel, as defined in claim 10, said controlling means comprising:

a counter which counts to a predetermined number and resets; and a second digital data memory which determines said predetermined number, said memory also determining whether said ratio is above or below 50%.

12. A method of controlling an AC plasma panel for displaying an image, said panel having inherent memory and having sustainer and driver circuitry for selectively addressing individual cells, comprising:

addressing said panel at a predetermined data rate; and concurrently applying a waveform selected from among a plurality of sustain waveforms to vary the intensity of light emitted from said entire image on said panel.

13. A brightness control for a plasma panel having an inherent memory comprising:

means for providing data at a constant data rate to said panel;

means responsive to said data providing means for writing said panel to set said inherent memory and for erasing said panel to unset said inherent memory;

means for generating a first sustain waveform for sustaining previously written locations on said entire panel, said first sustain waveform causing the emission of light from said entire panel; and means for generating a second brightness control sustain waveform for sustaining previously written locations on said entire panel, said brightness control sustain waveform causing the emission of substantially no light from said entire panel.

14. A brightness control, as defined in claim 13, wherein said brightness control sustain waveform does not cross AC zero.

15. A brightness control, as defined in claim 13, wherein said brightness control sustain waveform is a DC voltage.

16. A brightness control for a plasma panel having an inherent memory comprising:

means for providing data at a constant data rate to said panel;

means responsive to said data providing means for writing said panel to set said inherent memory and for erasing said panel to unset said inherent memory;

means for generating a write waveform for writing first selected locations on said panel to set said inherent memory, said write waveform causing the emission of light from said panel; and means for generating a brightness control write waveform for writing second selected locations on said panel to set said inherent memory, said brightness control write waveform causing the emission of substantially no light from all of said second selected locations on said panel.

17. A brightness control for an AC plasma panel having inherent memory comprising:

means for providing data at a constant data rate for writing said panel to set said inherent memory and erasing said panel to unset said inherent memory; and means for generating a brightness control erase waveform for erasing selected previously written locations on said panel, said brightness control erase waveform causing the emission of substantially no light from said panel.

18. A brightness control for an AC plasma panel having inherent memory comprising:

a plasma panel having a first electrode and a second electrode closely spaced from said first electrode at a point, said panel being filled with gas;

first means for providing a first address signal determining whether the panel is to emit light from said gas at the intersection of said first and second electrodes and setting said inherent memory;

second means for varying the intensity of said light at said intersection by varying the average number of discharges at said intersection;

third means for updating said first signal at a constant rate; and fourth means for sustaining the emission of light at the intensity controlled by said second means from said gas between changes in said first signal.

* * * * *